United States Patent [19]

Morrison

[11] Patent Number: 4,530,316

[45] Date of Patent: Jul. 23, 1985

[54] ROTATING CYLINDER INTERNAL COMBUSTION ENGINE

[75] Inventor: Ronald D. Morrison, Sherwood Park, Canada

[73] Assignee: Morrison Motor Company, Alberta, Canada

[21] Appl. No.: 376,695

[22] Filed: May 10, 1982

[51] Int. Cl.[3] ..... F02B 57/08

[52] U.S. Cl. ..... 123/44 R; 91/491

[58] Field of Search ..... 91/196, 197, 491; 123/43 R, 44 R, 44 B, 44 C, 44 D

[56] References Cited

U.S. PATENT DOCUMENTS

| | | | |
|---|---|---|---|
| 1,068,297 | 7/1913 | Baird et al. | 123/44 B |
| 1,095,074 | 4/1914 | Blayney | 123/43 R |
| 1,716,711 | 6/1929 | Southern | 123/43 R |
| 2,399,486 | 4/1946 | Harries | 123/44 C X |
| 3,292,603 | 12/1966 | Wayto | 123/43 R |

FOREIGN PATENT DOCUMENTS

| | | | |
|---|---|---|---|
| 29427 | 9/1931 | Australia | 123/44 B |

*Primary Examiner*—Michael Koczo

*Attorney, Agent, or Firm*—Sim & McBurney

[57] ABSTRACT

There is provided the combination of a stationary frame, a stationary sun gear on the frame, and a rotary frame pivoted about the axis of the sun gear. The rotary frame carries three crankshafts at substantially 120° intervals, and for each crankshaft there is provided a cylinder in the rotary frame, and a piston mounted for reciprocation in each cylinder. Each crankshaft is fixed to rotate with a respective planetary gear and all planetary gears mesh with the sun gear and have the same pitch diameter as the sun gear. Thus, any point on the pitch circle of a planetary gear describes a cardioid as the planetary gear rotates around the sun gear once. The crankshaft eccentricity is about one-third of the pitch radius of a planetary gear, and each piston has a connecting link to its respective crankshaft. Fuel metering means, such as a carburetor, are provided for delivering a combustible mixture to the cylinders. Ignition means are provided to ignite the combustible mixture, and valve means are present for admitting a combustible mixture to each cylinder and exhausting combustion gases therefrom.

4 Claims, 5 Drawing Figures

ROTATING CYLINDER INTERNAL COMBUSTION ENGINE

This invention relates generally to internal combustion engines and would also be applicable to compressors, and has to do particularly with an engine which combines the best advantages of a radial engine structure with cylinder and piston means.

BACKGROUND OF THIS INVENTION

In conventional reciprocating engines, the straight-line movement of pistons and parts is conveyed to the rotational movement of the crankshaft, which tends to produce energy loss due to poor rotational dynamics, and to sudden mass accellerations in the pistons and related parts. Because of the "stop-start" nature of the piston and connecting link action, considerable energy loss, wear and frictional forces are encountered, which tend to draw energy away into non-useful heat and to produce wear and degradation which, if eliminated, would lengthen the life of engine parts and improve effeciency.

Many radial engine designs have been devised in the past. However, most such designs do away with the piston/cylinder concept all together, and replace the combustion chamber with various forms of dynamic chambers defined between sliding or rotating members, the geometry being such as to increase and decrease the size of the combustion chamber. Such conventional radial engines have all encountered a number of problems in their development, with the result that few if any radial engine designs are commercially used in the automobile market at the present time in North America.

GENERAL DESCRIPTION OF THIS INVENTION

I have realized that the concept of a radial engine does offer certain features which it would be of advantage to utilize. One of the primary advantages is the production of centrifugal force in the rotating portion of the frame. I have recognized that it should be possible to utilize this rotational movement to (1) enhance the intake of the combustible mixture and the exhaust of combustion gases, (2) move lubricating oil in a preferential direction, and (3) facilitate valve movement. I have also arranged my design so that the piston under pressure moves away from center.

Essentially, my invention provides a rotary frame carrying three cylinder/piston combinations spaced at 120° intervals, the machine dynamics being arranged in such away that the pistons, while indeed reciprocating with respect to their individual cylinders, nonetheless when viewed from a stationary frame of reference are seen to move in a substantially circular path, thus reducing acceleration forces on the piston to a minimum, and contributing to an extremely smooth operation. Furthermore, the pistons are arranged so that they fire out from center (with the centrifugal force). Moreover, the connecting links undergo primarly a circular movement, although with a superimposed wobble. Finally, the eccentric portion of each crankshaft also travels in a near-circular motion, more accurately described as a modified cardioid.

Still more particularly this invention provides a combination including a stationary frame means to which a stationary sun gear is affixed. The rotary frame is pivoted about the axis of the sun gear, the rotary frame carrying three crankshafts at substantially 120° intervals. For each crankshaft there is a cylinder in the rotary frame, and a piston mounted for reciprocation in each cylinder. Each crankshaft is fixed to rotate with a respective planetary gear, and all planetary gears mesh with the sun gear and have the same pitch diameter as the sun gear. In this manner, any point on the pitch circle of a planetary gear describes a cardioid as the planetary gear rotates around the sun gear once. The crankshaft eccentricity is substantially about one-third of the pitch radius of a planetary gear. Each piston has a connecting link to its respective crankshaft. The engine further includes fuel metering means for providing a combustible mixture for the cylinders, ignition means to ignite the combustible mixture in each cylinder, and valve means for admitting a combustible mixture to, and exhausting combustible gases from each cylinder.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
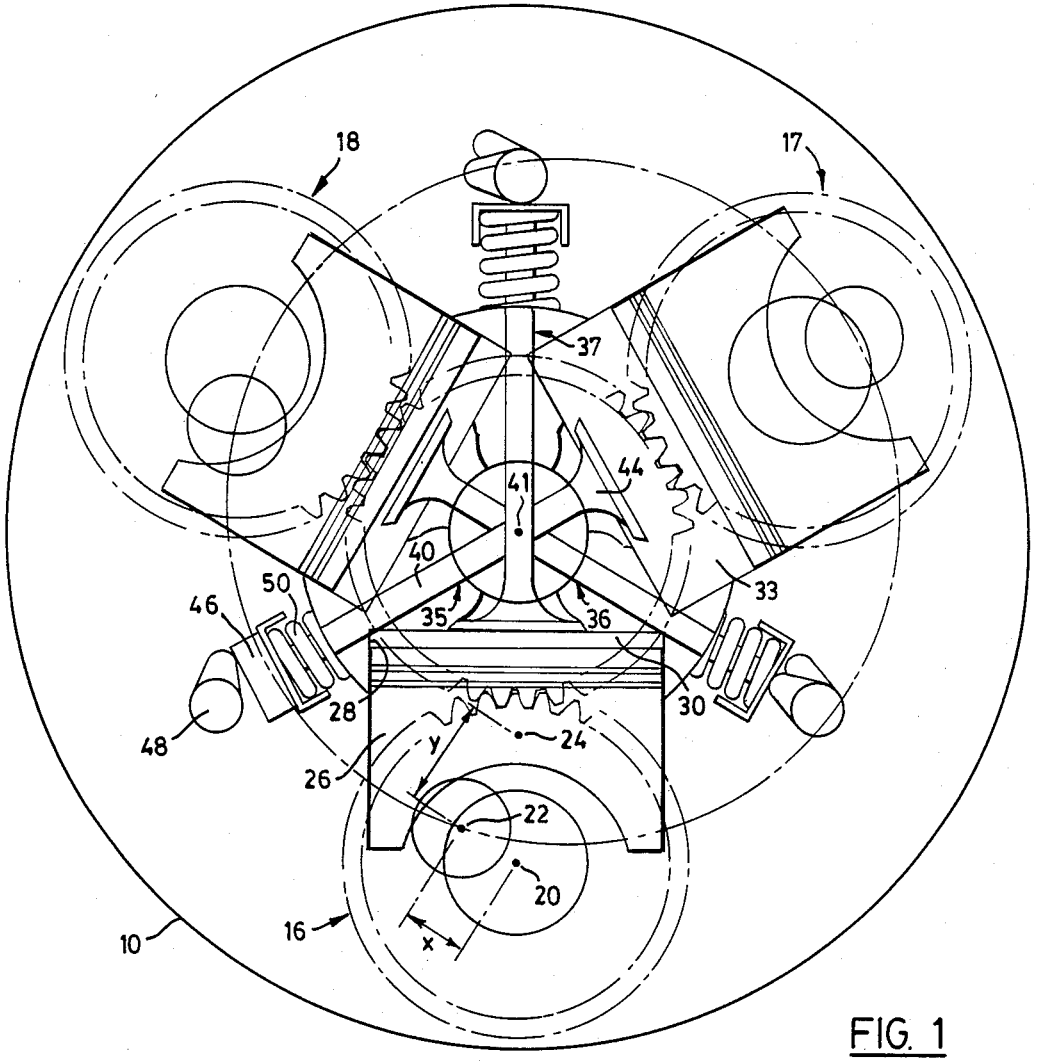
FIG. 1 is a somewhat diagrammatic axial view of an internal combustion engine constructed in accordance with this invention, showing cylinder, pistons, valves and gearing.

Attention is first directed to FIG. 1 in which the circle 10 represents the inside wall of the stationary frame 12 (seen in FIG. 3), within which a rotary frame (to be described in greater detail with respect to FIG. 3) is mounted to rotate. Fixed with respect to the stationary housing 12 is a stationary sun gear 14 with which three planetary gears 16, 17 and 18 mesh. All of the gears 14, 16, 17 and 19 have the same pitch diameter and number of teeth, such that as any one of the planetary gears 16, 17 or 18 rotates completely around the sun gear once, a point on the pitch circle of the rotating planetary gear describes a cardioid.

To each planetary gear 16, 17 and 18 is affixed a crankshaft. Referring to the planetary gear 16, the crankshaft has a main axis 20 and its eccentric journal portion has its axis at 22, the center-to-center distance between the axes 20 and 22 being referred to hereinafter by the letter x. A connecting link connects the journal portion of the crankshaft with a wrist pin of a piston moving in a cylinder. For the planetary gear 16, the axis of the wrist pin is designated by the numeral 24, the piston is identified by numeral 26, and the cylinder is designated by the numeral 28. The center-to-center distance between the axes 22 and 24, as established by the length of the connecting link, is marked in FIG. 1 as y.

Each of the planetary gears 17 and 18 has similar structure associated with it which need not be described with respect to FIG. 1.

It will thus be appreciated that, due to the geometry of the gears 14, 16, 17 and 18, each crankshaft will undergo two complete revolutions, as viewed from a stationary frame of reference, as its respective planetary gear revolves one complete circuit around the sun gear 14.

The combustion chamber for each piston lies radially inwardly of the piston, and for example is identified by the numeral 30 with respect to the piston 26. Each chamber lies between its respective crankshaft and the axis of the sun gear 14.

It will be appreciated that, although each crankshaft undergoes two complete revolutions as its respective planetary gear revolves once completely around the sun gear, the associated piston will make only one completely back-and-forth traverse of its cylinder during the same time.

In FIG. 1, the piston associated with the planetary gear 17 is located in its bottom dead center position, in which its associated combustion chamber 33 has the maximum volume. The other two cylinders are closer to the top dead center position, which occurs at the location diametrically opposite that of the cylinder for planetary gear 14 as pictured in FIG. 1.

The matter of the geometry of movement of the gears, crankshafts, connecting links and pistons will be made clear subsequently with respect to FIG. 4.

Still referring to FIG. 1, there are shown three valves 35, 36 and 37. For the sake of simplicity, only valve 35 will be described in detail with reference to FIG. 1. As can be seen in the Figure, the valve 35 has a valve stem 40 which extends across the center of rotation 41 of the assembly, and a valve head 44 is connected to the valve 40 in the usual manner. At its end remote from the valve head 44, the valve stem 40 has a tappet 46 which follows a cam 48, the gearing and control for which will be described subsequently. A spring 50 urges the tappet 46 and the valve 35 into the closed position, i.e. downwardly to the left as seen in FIG. 1.

Figure 2:
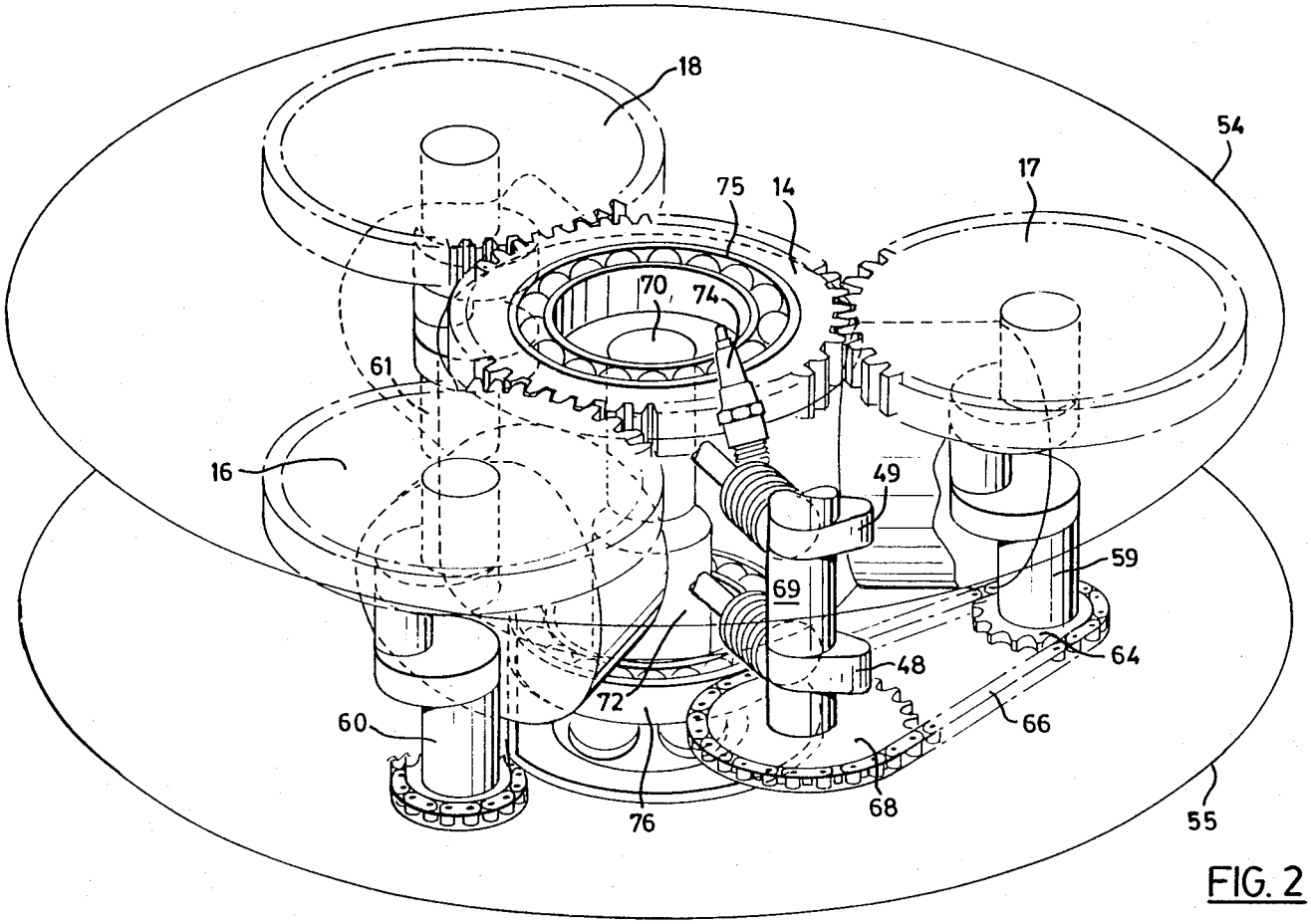
FIG. 2 is a schematic and perspective view of the engine of FIG. 1, with certain portions broken away to enhance clarity.

Attention is now directed to the schematic drawing of FIG. 2, in which the sun gear 14 and the three planetary gears 16, 17 and 18 are again shown. The ellipses 54 and 55 in FIG. 2 represent the axial limits of the housing 12 within which the rotary assembly rotates.

FIG. 2 is such that the crankshafts 59, 60 and 61 can be more clearly shown. The distance x is marked on FIG. 2 for the crankshaft 59. Also, it can be seen in FIG. 2 that the crankshaft 59 turns a sprocket 64 around which is entrained an endless chain 66, which is also entrained around a further sprocket 68 which rotates a cam shaft 69 on which are mounted cams 48 and 49. In actual fact, there will be two valves for each cylinder, one for the intake and one for the exhaust. FIG. 1 shows only one valve, but it is to be understood that in the FIG. 1 view, the two valves are aligned and the one more remote from the viewer is not seen.

It will of course be understood that the items shown in FIG. 2 will all be mounted on a rotary assembly (subsequently to be described with respect to FIG. 3), which cannot be shown in FIG. 2 as it would hopelessly clutter an already complex drawing.

FIG. 2 further shows, in a schematic form, an inlet pipe 70, and an exhaust passage 72. These passages or chambers are not in communication. Finally, FIG. 2 shows a spark plug 74 which is one of three, and which has its spark gap in communication with one of the combustion chambers within one of the piston cylinders. Two main bearings 75 and 76 are also illustrated in FIG. 2, the bearing 75 being in alignment with the sun gear 14.

Figure 3:
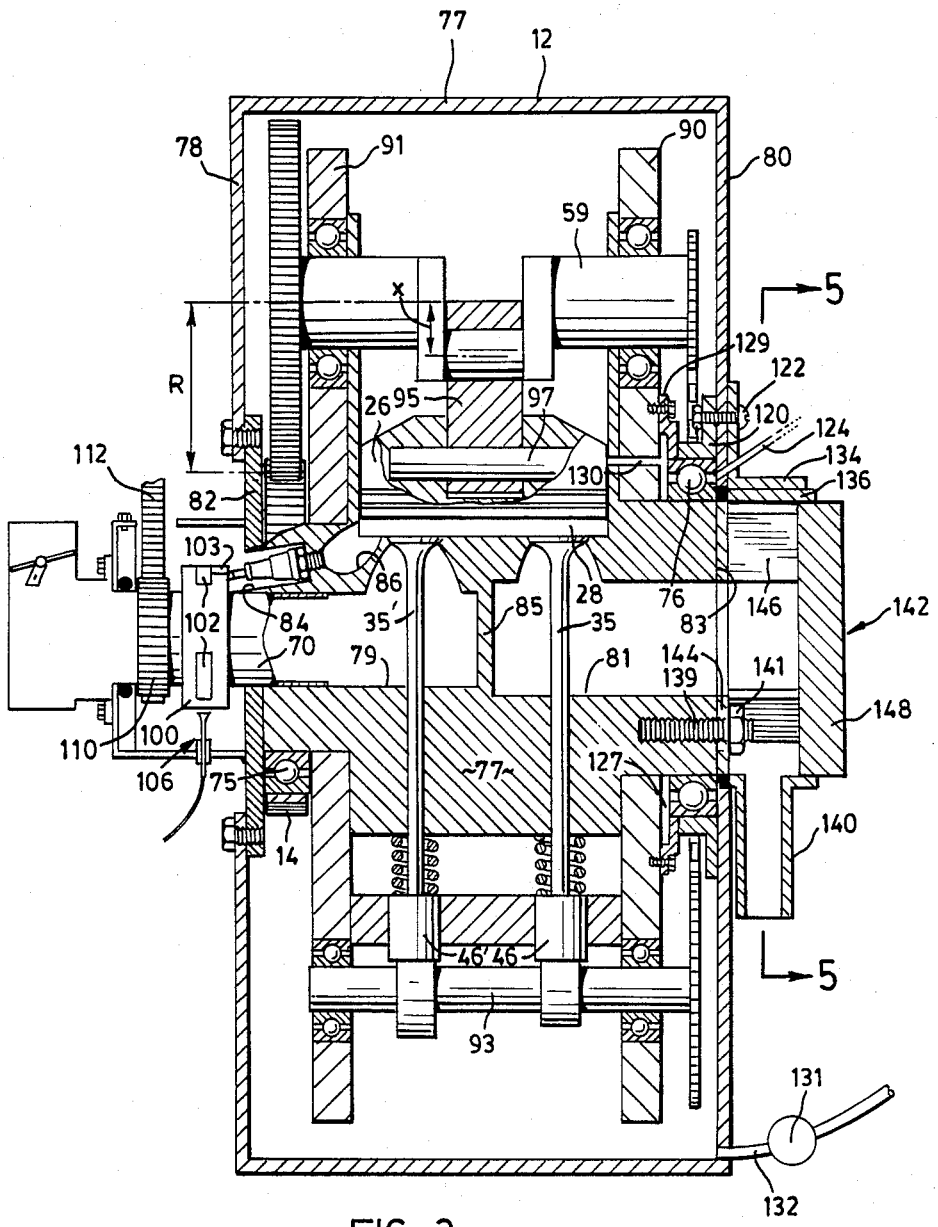
FIG. 3 is an axial sectional view through the engine of FIG. 1, with certain parts shown in elevation as well as in section.

Attention is now directed to FIG. 3, for a more detailed description of the structure of the engine.

In FIG. 3 the stationary housing consists of an outer cylindrical wall 77 and two annular side walls 78 and 80. The walls 78 are secured to plate 82 to which is affixed the stationary sun gear 14. Within the stationary sun gear is the main bearing 75 which mounts the leftward end of a rotary body 77, in which are provided the piston cylinders, one of which is identified by the numeral 28. The intake pipe 70 is inserted into the intake bore 79, the latter being separated from an exhaust bore 81 by a wall 85. The exhaust bore opens rightwardly through the end 83 of the rotary body 77.

Three spark plug access openings of which one is seen at 84 in FIG. 3 are provided in the rotary body 77, and open into pockets communicating with the cylinders, one pocket being shown at 86 in FIG. 3.

Two annular rotary flanges 90 and 91 are affixed to the rotary body 77 to rotate therewith. The flanges 90 and 91 support the cam shafts, one of which is shown at 93 in FIG. 3, and also support for rotation the crankshafts, of which one is identified at 59 in FIG. 3. Within the cylinder 28 the piston 26 has been shown, and the connecting link between the crank shaft 59 and the piston 26 is identified in FIG. 3 by the numeral 95.

The connecting link 95 is secured about a wrist pin 97 in conventional manner, the wrist pin being secured to the piston 26.

FIG. 3 shows its tappets 46 and 46' for the valves 35 and 35', and it can be seen how the intake bore 79 and the exhaust bore 81 are shaped to provide valve seats for the valves 35 and 35'. At the left in FIG. 3 a rotary annular plastic insulator 100 is provided on the intake pipe 70 to rotate therewith. The insulator carries 3 brass strips at intervals of 120°, each one being connected to one of the spark plugs via wire, of which one is shown at 103. Means are provided for bringing the high voltage output of a coil into contact of the brass strips 102 at appropriate times for ignition, the means being shown schematically by the numeral 106. The means 106 is mounted in a stationary housing 108 fixed with respect to the plate 82. Adjacent the plastic insulator 100, there is affixed to the intake pipe 70 (which rotates) a gear 110 around which a belt drive 112 is entrained. The belt drive 112 is in turn entrained around a drive gear (not shown) which initiates the high voltage signal in the coil at the appropriate points in time. It is not necessary to detail this area any further, since those skilled in the art will readily appreciate how to arrange for the coil signal to be brought to the spark plugs at the correct points in the cycle.

Attention is now directed to the right hand portion of FIG. 3 where it can be seen that the wall 80 of the stationary housing 12 is secured to a bracket 120 by suitable fasteners 122 or the like, the bracket 120 being annular in shape, and engaging the outside of the main bearing 67, the latter contacting the body 77 on its inside. An oil inlet pipe 124 accepts oil from an oil pump and delivers the oil to the bearings 76, to which it passes to a chamber 127 defined between the annular flange 90, the bearing 76, and an annular cap member 129. From the chamber 127, a plurality of ports 130 are drilled through the annular flange 90 and body 77 to communicate with the cylinders, for example the cylinder 28 shown in FIG. 3. An oil pump 131 draws oil from the bottom of the stationary housing 12 along an oil line 132. Secured to the outside of the wall 80 is a part-circular flange 134 which surrounds and holds an exhaust manifold 136, of which the exhaust pipe 14 is an integral part.

Figure 5:
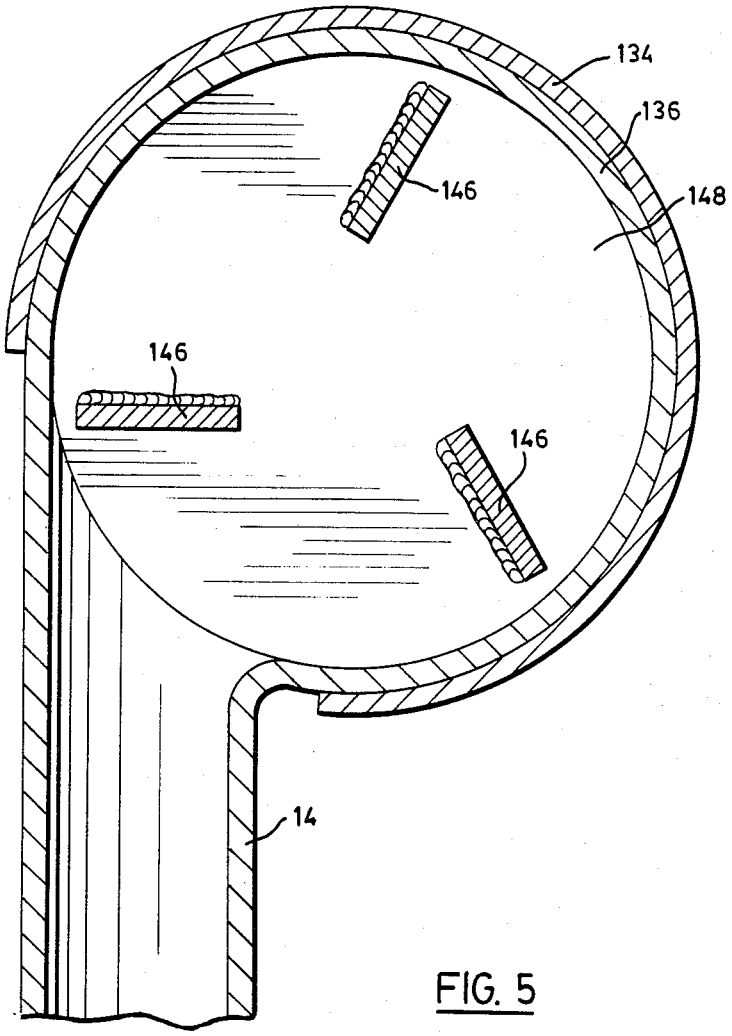
FIG. 5 is a sectional view taken on the line 5—5 in FIG. 3.

Fastened to the rightward end of the body 77, by threaded shanks 139 screwed into tapped bores in the body 77 and fitted with nuts 141, is an impeller assembly 142 which includes an annular plate 144, three blades 146 (see FIG. 5), and a power take-off plate 148. As can be seen, the manifold 136 has a close fit around the plate 148, to ensure that exhaust gases pass outwardly through the exhaust pipe 14. The plate 148 is the element at which power is taken away from the engine, and this plate would be suitably bored and tapped to receive threaded members for fastening to a drive shaft, universal drive, or any other appropriate component.

Figure 4:
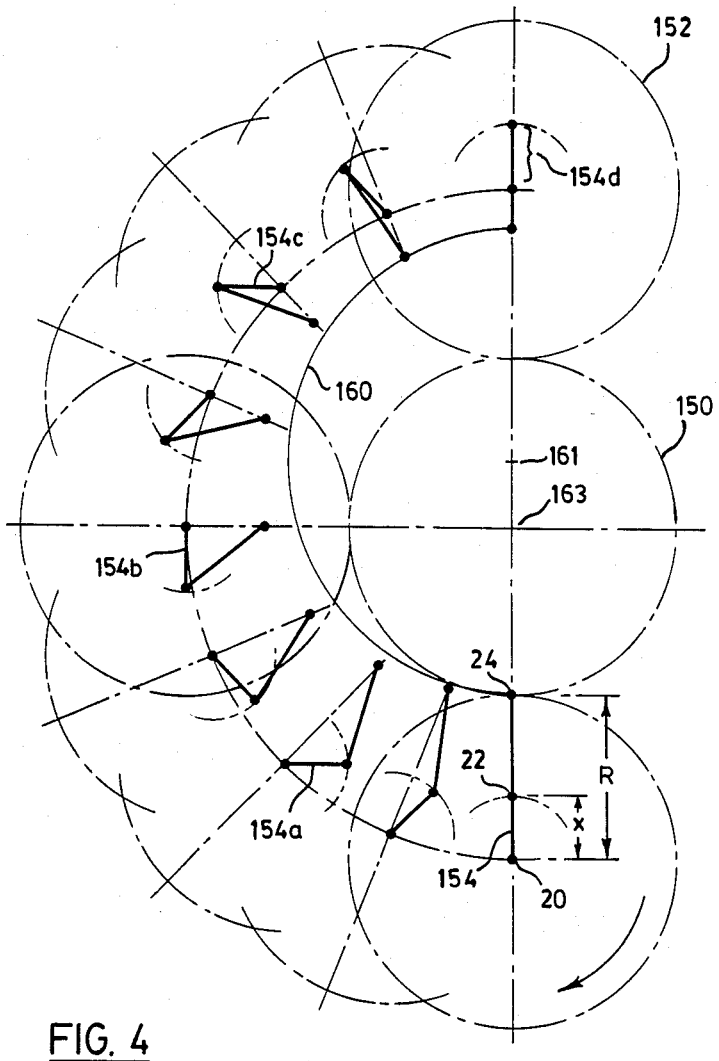
FIG. 4 is a schematic drawing to show the geometry which describes the movement of each piston through one complete revolution of the rotary frame of the engine.

Attention is now directed to FIG. 4, which shows geometrically that, by arranging for the crank eccentricity x to be about $1/\pi$ of the pitch radius R of the planetary gear, and with a connecting link length of about 2x, the pistons travel in a substantial circle.

In FIG. 4, the sun gear pitch circle is shown at the numeral 150. The pitch circle of one planetary gear is shown at 152. As above stated, the planetary and sun gears have the same pitch diameter (=2R).

FIG. 4 shows one-half of a complete cycle, with the planetary gear moving through 180° around the sun gear. At the bottom in FIG. 4, the axes 20, 22 and 24 are identified. The arm between 20 and 22 represents the crank eccentricity x, with 22 being the axis of the crank journal, while the arm 22 to 24 represents the center-to-center length of the connecting link. The planetary gear is assumed to begin at the bottom in FIG. 4, and to rotate in the clockwise direction about its own axis, thus carrying it in the clockwise direction from the bottom position in FIG. 4 to the top position in FIG. 4. The movement of the crank between the axes 20 and 22 is shown at intervals of $22\frac{1}{2}$°. By the time the planetary gear axis reaches 45° in its travel, the crank arm 154 has rotated through 90° as seen at position 154*a*. After another 45°, the crank arm points straight downwardly as seen at 154*b*. 45° later, the crank arm extends to the left as seen at 154*c*, and in the uppermost position, the crank arm extends upwardly as seen in position 154*d*. The intermediate positions have also been drawn, but not labeled. The movement of axis 24 is clearly seen in FIG. 4, over this half-cycle. In order to show that this movement is a very close approximation of a true circle, a semi-circular line 160 has been drawn with a center at the location 161, which lies above the axis 163 of the sun gear (pitch circle 150) by the distance x (i.e. by the same distance as the eccentricity of the crank.

It will thus be appreciated that by making the crank throw equal to roughly one-third or $1/\pi$ of the pitch radius R, and by using roughly 2x for the length of the connecting link, the piston, which follows the axis 24, can be made to move in a near perfect circle.

Hence, the piston is not subject to anything other than a substantially constant centrifugal force. This means that the piston is free of shock loading, and also free of widely varying acceleration forces. This cuts down considerably on piston wear.

As previously stated, the centrifugal force generated by the rotating assembly is also useful to cast outwardly the oil entering the cylinders through the ports 130, thus minimizing the burning of oil in the cylinder. The arrangement also tends to maintain the oil pressure in line with speed requirements, since the pressure varies as the square of the rotational speed.

The centrifugal force also enhances the intake and exhaust functions with the present design.

As seen in FIG. 3, the valves extend across the center line of the rotating assembly. By selecting the amount of weight of the valve on either side of the center line, the closing and opening force can easily be adjusted to maximize efficiency and function.

While a particular embodiment has been illustrated in the accompanying drawings and described above, those skilled in the art will appreciate that changes and modifications may be made therein without departing from the essence of this invention as set forth in the appended claims.

I claim:

1. In combination:

stationary frame means, a stationary sun gear on the frame means, a rotary frame pivoted about the axis of the sun gear, the rotary frame carrying three crankshafts at substantially 120° intervals, for each crankshaft a cylinder in the rotary frame and a piston mounted for reciprocation in each cylinder, the axis of each cylinder being radial with respect to the axis of the sun gear, each piston lying between its respective crankshaft and the axis of the sun gear, each crankshaft being fixed to rotate with a respective planetary gear, all planetary gears meshing with the sun gear and having the same pitch diameter as the sun gear, whereby any point on the pitch circle of a planetary gear describes a cardioid as the planetary gear rotates around the sun gear once, the crankshaft eccentricity being substantially one-third of the pitch radius of a planetary gear, whereby each piston moves in a substantially circular orbit as the rotary frame turns, each piston having a connecting link to its respective crank shaft, fuel metering means for providing a combustible mixture for the cylinders, ignition means to ignite the combustible mixture in each cylinder, and valve means for admitting a combustible mixture to, and exhausting combustion gases from, each cylinder, the valve means including, for each cylinder, an intake valve and an exhaust valve, each valve having its axis substantially intersecting the sun gear axis at a point intermediate the ends of the valve stem.

2. In combination:

stationary frame means, a stationary sun gear on the frame means, a rotary frame pivoted about the axis of the sun gear, the rotary frame carrying three crankshafts at substantially 120° intervals, for each crankshaft a cylinder in the rotary frame and a piston mounted for reciprocation in each cylinder, the axis of each cylinder being radial with respect to the axis of the sun gear, each crank shaft being fixed to rotate with a respective planetary gear, all planetary gears meshing with the sun gear and having the same pitch diameter as the sun gear, whereby any point on the pitch circle of a planetary gear describes a cardioid as the planetary gear rotates around the sun gear once, the ratio of the planetary gear pitch radius to the crankshaft eccentricity being substantially Pi, whereby the piston moves in a substantially circular orbit as the rotary frame turns, each piston having a connecting link to its respective crank shaft, fuel metering means for providing a combustible mixture for the cylinders, ignition means to ignite the combustible mixture in each cylinder, and valve means for admitting a combustible mixture to, and exhausting combustion gases from, each cylinder, the valve means including, for each cylinder, an intake valve and an exhaust valve, each valve having its axis substantially intersecting the sun gear axis at a point intermediate the ends of the valve stem.

3. The engine claimed in claim 1, or claim 2, in which the length of each connecting link is substantially twice the crankshaft eccentricity.

4. The engine claimed in claim 1 or claim 2, which further includes a stationary housing surrounding the rotary frame, an oil pump, an oil suction line from the intake of the oil pump to a low point on the stationary housing, and an oil delivery pathway from the delivery of the oil pump to the side wall of each cylinder, whereby centrifugal force urges the oil away from the combustion zone of the cylinder.

* * * * *